US007950114B2

(12) United States Patent
Duffy

(10) Patent No.: US 7,950,114 B2
(45) Date of Patent: May 31, 2011

(54) SELF-ADHERING DEVICE AND METHOD

(76) Inventor: Leonard Arnold Duffy, Hinesburg, VT (US)

( * ) Notice: Subject to any disclaimer, the term of this patent is extended or adjusted under 35 U.S.C. 154(b) by 963 days.

(21) Appl. No.: 11/891,404

(22) Filed: Aug. 10, 2007

(65) Prior Publication Data

US 2008/0034560 A1 Feb. 14, 2008

Related U.S. Application Data

(63) Continuation-in-part of application No. 11/076,489, filed on Mar. 9, 2005, now Pat. No. 7,254,874.

(60) Provisional application No. 60/551,757, filed on Mar. 10, 2004.

(51) Int. Cl.
*A44B 18/00* (2006.01)

(52) U.S. Cl. ..... 24/452; 24/445

(58) Field of Classification Search ..... 24/306, 24/442–452, 585.1, 585.11, 584.1, 381–436
See application file for complete search history.

(56) References Cited

U.S. PATENT DOCUMENTS 3,101,517 A 8/1963 Fox
3,147,528 A 9/1964 Erb
3,266,113 A 8/1966 Flanagan, Jr.
3,325,084 A 6/1967 Ausnit
3,408,705 A 11/1968 Kayser et al.
3,462,805 A * 8/1969 Quisling ..... 24/401
3,522,637 A * 8/1970 Brumlik ..... 24/445
3,526,867 A 9/1970 Kieler, II
3,758,657 A 9/1973 Menzin et al.
3,899,805 A 8/1975 McMillan
4,183,121 A 1/1980 Cousins
4,531,733 A 7/1985 Hall
4,775,310 A 10/1988 Fischer
4,894,060 A 1/1990 Nestegard
4,946,527 A 8/1990 Batrell
5,067,210 A 11/1991 Kayaki
5,097,570 A 3/1992 Grsshenson
5,179,767 A * 1/1993 Allan ..... 24/442
5,212,855 A 5/1993 McGanty
5,382,462 A 1/1995 Pacione
5,460,769 A 10/1995 Kaneko
5,555,608 A 9/1996 Allan
5,634,245 A 6/1997 Rouser
5,640,744 A 6/1997 Allan
5,655,268 A 8/1997 Keyaki et al.
5,656,226 A 8/1997 McVicker
5,797,170 A 8/1998 Akeno
5,839,172 A 11/1998 Takizawa et al.
5,867,876 A 2/1999 Petersen
5,884,368 A 3/1999 Boe
5,891,549 A 4/1999 Beretta et al.
5,913,482 A 6/1999 Akeno
5,943,705 A 8/1999 Sink
5,953,797 A 9/1999 Provost et al.
5,983,467 A 11/1999 Duffy
5,987,706 A 11/1999 Boe
6,054,091 A 4/2000 Miller et al.
6,061,881 A 5/2000 Takizawa et al.

(Continued)

*Primary Examiner* — Robert J Sandy

(57) ABSTRACT

A self-adhering device connects two portions in a surface-to-surface interfaced juxtaposition by resiliently interspersing undercut nodules within corresponding receptors. At least one portion is generally flexible. The device may be configured in diverse configurations including alternative geometries, double-sided embodiments, and embodiments with no greater thickness when attached than when unattached. The method of use includes application of a relative compressive force to the portions which may be optionally provided by a sliding mechanism.

20 Claims, 10 Drawing Sheets

U.S. PATENT DOCUMENTS

Figure 1:
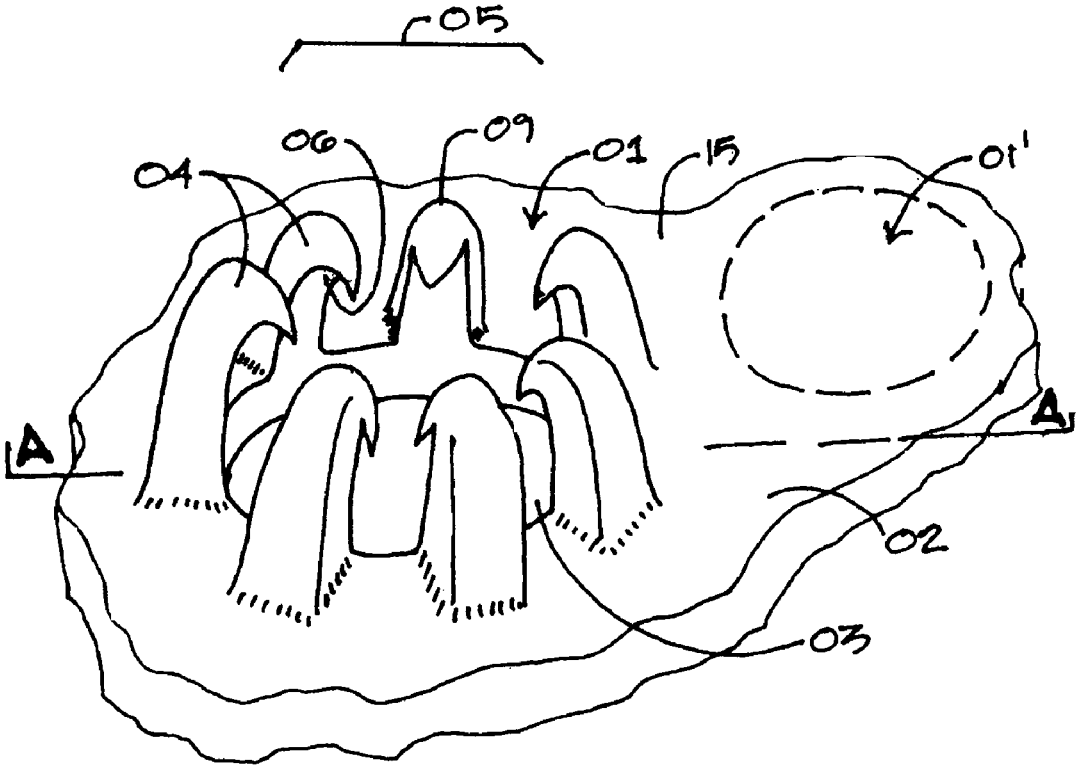

| | | | |
|---|---|---|---|
| 6,132,660 | A | 10/2000 | Kampfer |
| 6,179,625 | B1 | 1/2001 | Davis |
| 6,209,177 | B1 | 4/2001 | Murasaki et al. |
| 6,224,364 | B1 | 5/2001 | Harvey |
| 6,248,276 | B1 | 6/2001 | Parellada et al. |
| 6,258,311 | B1 | 7/2001 | Jens et al. |
| RE37,338 | E | 8/2001 | McVicker |
| 6,317,933 | B1 | 11/2001 | Suenaga |
| 6,430,784 | B1 | 8/2002 | Dudek et al. |
| 6,430,786 | B1 | 8/2002 | Ikeda |
| 6,449,816 | B1 | 9/2002 | Dudek et al. |
| 6,478,784 | B1 | 11/2002 | Johnson et al. |
| 6,526,633 | B2 | 3/2003 | Provost et al. |
| 6,656,563 | B1 | 12/2003 | Leach et al. |
| 6,678,924 | B2 | 1/2004 | Murasaki et al. |
| 6,684,464 | B1 | 2/2004 | Mody et al. |
| 6,687,962 | B2 | 2/2004 | Clarner et al. |
| 6,692,674 | B1 | 2/2004 | Kurtz et al. |
| 6,694,576 | B1 | 2/2004 | Fujisawa et al. |
| 6,708,378 | B2 | 3/2004 | Parallada et al. |
| 6,720,059 | B2 | 4/2004 | Fujisawa et al. |
| 6,737,147 | B2 | 5/2004 | Kennedy et al. |
| 7,036,190 | B2 | 5/2006 | Demarist |
| 7,048,984 | B2 * | 5/2006 | Seth et al. ..... 24/452 |
| 2001/0022012 | A1 | 9/2001 | Shepard et al. |
| 2001/0022409 | A1 | 9/2001 | Parallada et al. |
| 2002/0124359 | A1 | 9/2002 | Murasaki |
| 2003/0074771 | A1 | 4/2003 | Duffy |

* cited by examiner

A—A

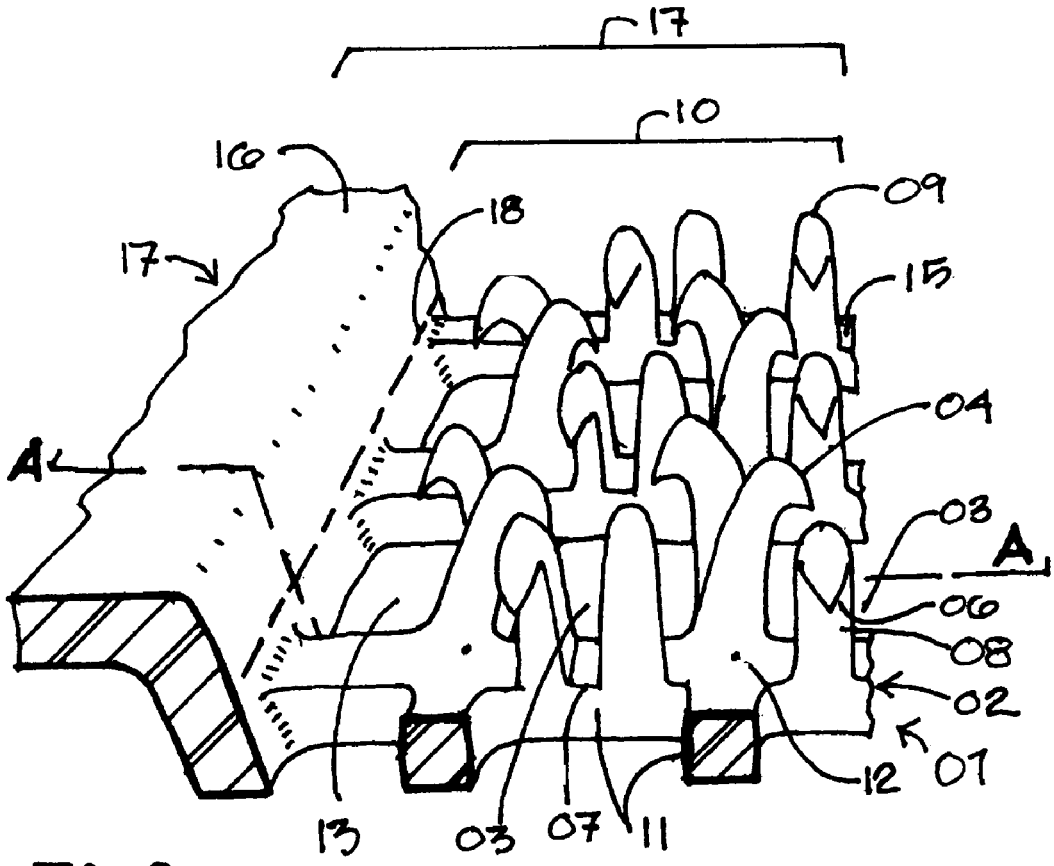
Fig.2
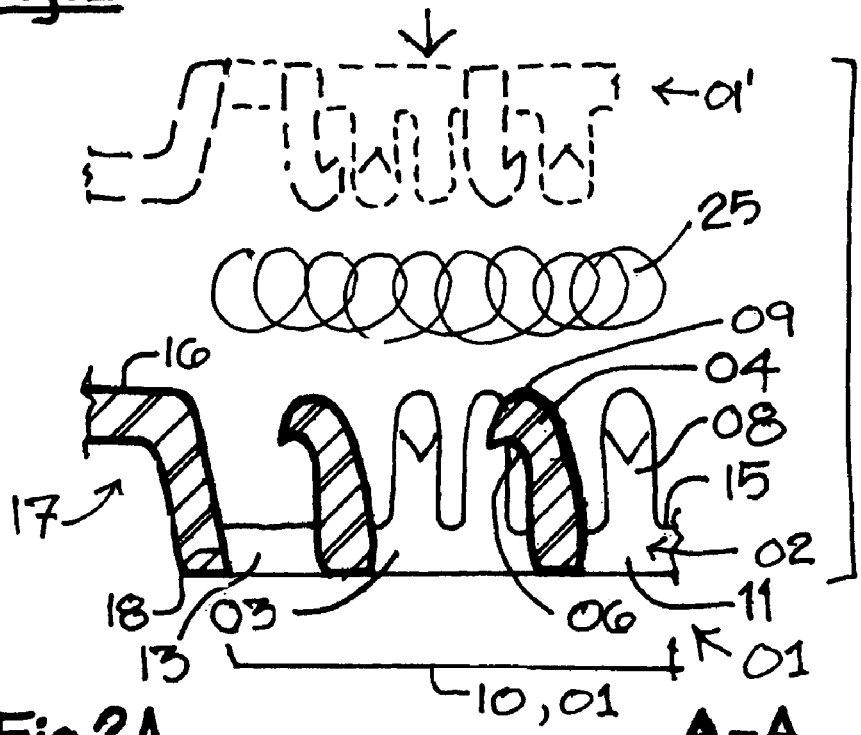
Fig.2A A-A

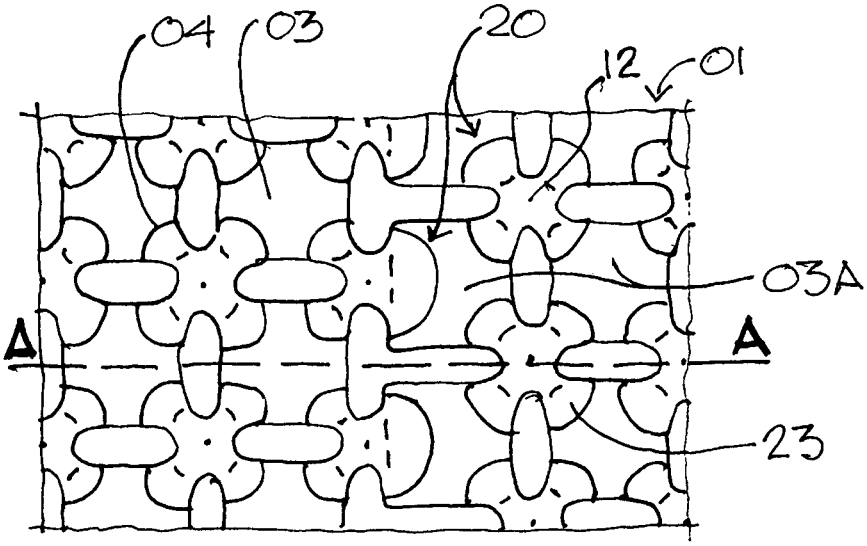
Fig. 4
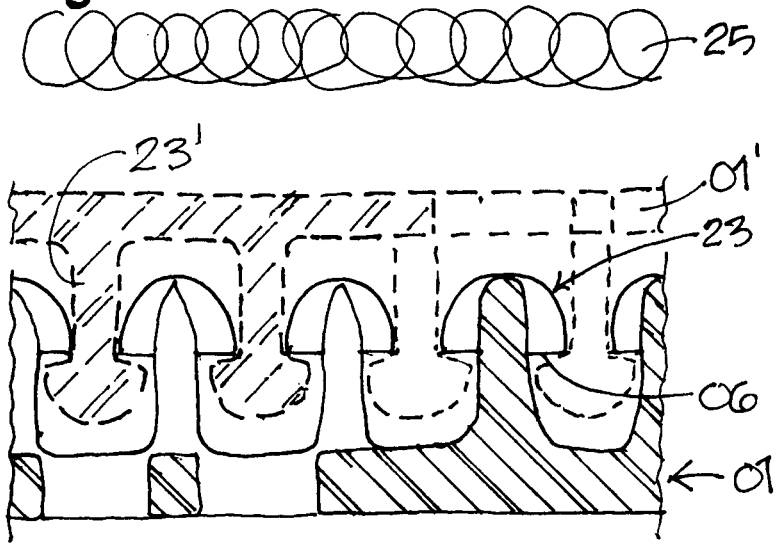
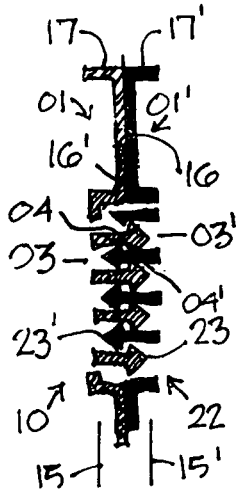
Fig. 4A A-A Fig. 4B

Fig.5A A-A

Fig. 6A A-A

SELF-ADHERING DEVICE AND METHOD

PRIORITY

This application is a continuation-in-part of application Ser. No. 11/076,489, filed Mar. 9, 2005, now U.S. Pat. No. 7,254,874, which claims the benefit of U.S. Provisional Application No. 60/551,757, filed Mar. 10, 2004.

RELATED APPLICATIONS

This application is related to U.S. Pat. No. 7,246,416 issued on Jul. 24, 2007, entitled "Slidingly Engagable Fasteners and Method", and subsequent continuation-in-part U.S. Pat. No. 7,828,545 issued on Nov. 9, 2010, entitled "Apparatus and method for producing structures with multiple undercut stems". This application is also related to U.S. patent application Ser. No. 11/364,929 filed Mar. 1, 2006, entitled "Unitary Wrap" now abandoned.

FIELD

This application relates to the field of generally flexible surface (touch) fasteners with interdigitating elements of diverse types such as hook-and-loop and self-engaging (mushroom) types, zipper-like slide fasteners, and generally to devices and methods for connecting two flexible portions.

BACKGROUND

The field of surface fasteners, including hook-and-loop and self engaging types, is well established, as evidenced by numerous US and international patents for fasteners and methods of manufacturing since at least the mid $20^{th}$ century. Improvements in the field have largely focused on developing diverse hook and mushroom designs, arraying fastening elements on a surface, increasing hook density, and methods of manufacturing such fasteners in continuous batches by molding or extrusion techniques. In general, these systems include a plurality of hook-like or mushroom-like fastening elements which extend from a generally contiguous sheet form base, with the individual hooks or mushrooms having undersides spaced away from the base.

Molded hookstrips are now often manufactured in a continuous strip on a rotating mold from which individual hooks are stripped by elastically pulling the undercut ends from the mold (for example Jens et al U.S. Pat. No. 6,258,311). Mushroom fasteners as well as some hook fasteners are typically manufactured by first continuously molding a sheet form base with post forms, then heat forming the post ends into a bulbous shape (for example Provost et al U.S. Pat. No. 6,526,633, Parellada et al U.S. Pat. No. 6,708,378 B2).

Typically, both hook-and-loop and self-engaging mushroom fasteners are manufactured as subsidiary products to be attached to a primary product. Fabric like hookstrips are generally contiguous with a woven base and are typically sewn to clothing or flexible materials. Molded hookstrips, as well as self-engaging mushroom systems, are typically molded integrally with a sheet form base which is then attached to a relatively rigid primary product structure by adhesive, welding, or mechanical means. These attachment methods can be problematical in that adhesives may fail, edge peeling often occurs, and they generally result in a relatively thick assembly. Even recently developed "low profile" systems generally have significant thickness which prevents adjoining components from being joined in a flush juxtaposition and are therefore not suitable for many assembly applications. In addition, attached fasteners can be relatively costly for an end product manufacturer in terms of inventory, assembly time, and potential returns. Other factors such as color matching, material compatibility, durability, and material efficiency of the fastener are drawbacks of attached fasteners for many applications. Applications for such attached fasteners are limited by the necessity of attaching the fastener, assuring adhesion, cost, and the relative thickness of the resultant assembly. Therefore, particularly in assembly processes, other methods of attachment are frequently chosen.

In recent years several patents have been issued regarding methods of integrally molding hook-and-loop type hookstrips as part of a primary product (McVicker U.S. Pat. No. 5,656,226, Harvey U.S. Pat. No. 6,224,364 B1, Murasaki et al U.S. Pat. No. 6,678,924 B2). In many instances such integrally molded surface fasteners would appear to be advantageous to industry. However, because these techniques are based upon forcibly removing hook-shaped elements with "blind" undersides from a mold, they appear to be limiting: necessitating complex manufacturing methods; resulting in compromised hook designs of relative weakness; limiting choice of plastic materials; and requiring relatively long dwell times. All of these factors would appear to increase relative cost as well as limit functionality and potential applications.

A few patents and applications have disclosed double-sided surface fasteners (i.e. Kennedy et al U.S. Pat. No. 6,737,147B2, Shepard et al US 2001/0022012 A1, Dudek et al U.S. Pat. No. 6,449,816 B1) Generally these disclosures include means for attaching independently manufactured hookstrip and loop fastener portions in a back to back configuration, resulting in a relatively thick overall assembly when connected.

In pending U.S. patent application Ser. No. 10/015,087, the present applicant has disclosed a method and apparatuses for producing surface fasteners of the slidingly engaging type by utilizing a set of bypassing/biparting dies. This method, among other attributes, allows fastening elements with effectively "blind" undersides to be precisely and economically manufactured with a relatively simple reciprocating molding machine as an integral part of a primary product, or by a continuous molding machine incorporating a rotating die set.

Several examples of prior art include surface fasteners having undercut fastening elements which extend from a fenestrated base structure. Kayaki U.S. Pat. No. 5,067,210 discloses a device having rows of two directional hook sets formed between contiguous structural rows, so as to have a fenestrated base with hook undersides opposite windows in the base. Pacione U.S. Pat. No. 5,384,462 discloses a carpet tape with a fenestrated base structure and hook like elements which do not appear to be related to individual fenestrations. Allan U.S. Pat. No. 5,555,608 discloses (FIG. 19) a somewhat similar structure having individual hooks arrayed in rows of alternating orientation projecting between rows of contiguous structure. In his U.S. Pat. No. 5,640,744, Allan also discloses a fenestrated fastening portion with rib like fastening elements of a similar profile which appears to be double sided. Akeno U.S. Pat. No. 5,797,170 discloses a "mushroom type" fastener wherein individual undersides of each multi-sided fastening element is configured opposite an opening in the fenestrated base structure. Although these examples disclose surface fasteners which appear to be moldable with a byparting die set, their utility seems limited. In each case, the "window" through the base structure is relatively small in relationship to the size of the undercut or "hook" element, which is generally equal to or only slightly larger than the corresponding undercut area. Therefore, hook (or mushroom)

density is limited by the number of mold cavities which can reasonably be arrayed in a unit of area because projecting (male) die elements of relatively small dimension would be expected to result in limited mold life. Of the prior art known, only Kayaki provides a system having more than one (two) undercut elements associated with each window, and his invention is further limited in terms of potential hook density and hook orientation by a geometry incorporating singular width rows and columns Thus it can be seen by examination of the prior art that there is room for significant improvement in the field. Integrally molded fasteners of both the hook-and-loop and mushroom types which can be manufactured by an improved method would be useful. Inexpensive surface fasteners with greater material efficiency would be beneficial. Fastening elements of diverse designs with precise details which can be economically manufactured without limitation by mold removal requirements is desirable. Fasteners with minimal profile thickness would have great utility. Double-sided fasteners and fastener strips with multiple fastening zones have many potential applications. Improved methods for economically assembling products and components are needed. Other applications for improved surface fasteners will be seen throughout this disclosure.

Regarding Self-attaching Systems:

Fastening systems which include hermaphroditic arrays of interengaging mushroom-like structures are relatively well known, such as the system marketed by 3M Corporation as Dual-Lock®. Generally, these systems include relatively flexible stems with overhanging end portions connected to a sheet-form base arrayed in patterns designed to restrict shear as in the examples noted above. Other examples of interdigitating fasteners associated with a sheet form base include: Fox et al U.S. Pat. No. 3,101,517; Ausnit U.S. Pat. No. 3,325,084; McMillan U.S. Pat. No. 3,899,805; Batrell U.S. Pat. No. 4,946,527; Gershenson U.S. Pat. No. 5,097,570; McGanty U.S. Pat. No. 5,212,855; Rouser U.S. Pat. No. 5,634,245; and Davis, U.S. Pat. No. 6,179,625 B.

Gershenson, et al U.S. Pat. No. 5,799,378 discloses a fastening system comprised of two like plates of intersecting walls with bulbous heads on stems at the intersections of the walls for engaging with the generally steeply sloped lower sidewalls of complementary such heads. When engaged, the heads effectively bypass one another by a distance equal to the effective length of their stems, and the walls include stepped segments to accommodate complementary wall segments. The structure appears to comprise generally rigid portions for fastening rigid components and it can be appreciated that even relatively slight flexure of either portion would tend to cause disengagement as the sloped lower sidewalls are caused to bypass. Boe U.S. Pat. No. 5,987,706 discloses a coupling apparatus comprising a plurality of spaced apart apertures with projections positioned on the intervening structure for engaging with like apertures, apparently retained by longitudinal tension when the portions are wrapped around a bundle. Recently, Demarest U.S. Pat. No. 7,036,190B2 discloses a device comprising low-profile flexible interdigitating portions with members retained in engagement within alternately sloped chambers. His disclosure points to the desirability of providing flexible closures for certain types of apparel.

OBJECTS OF THE INVENTION

A first object of the present invention is to provide surface fasteners which can be economically manufactured. Another object of the invention is to provide surface fasteners which can be integrally molded as part of a primary product. Another object is to provide surface fasteners which can incorporate a diversity of precise fastening element designs, including hooks for attaching to complementary loop structures as well as self-engaging fastening systems. Another object is to provide surface fasteners which incorporate fastening elements arrayed in multidirectional orientations. Another object is to provide surface fasteners which are efficient in material consumption. Another object is to provide unitary surface fasteners with two integral active sides. Another object is to provide surface fasteners having fastening element zones which are recessed or otherwise differentiated from at least part of a surrounding surface. Another object is to provide surface fasteners which incorporate fastening elements of diverse types at disparate surface zones. Another object is to provide surface fasteners which are of very low profile. Another object is to provide methods of attaching and assembling product components utilizing improved surface fasteners. Another object is to provide surface fasteners with relatively high hook density. Another object is to provide "button"-like surface fasteners with fastening elements arrayed in sets about a singular window or cluster of windows in a structure.

Further objects of the present invention include providing relatively low profile self-adhering structures which are self-engaging and provide surface-to-surface interface. A further object is to provide such structures which have no greater thickness when attached than when unattached, which can be furnished in various designs of diverse materials and combinations of materials, which can be furnished in double-sided configurations, and which when furnished as an edge fastening device may be operated with a sliding mechanism. A further object is to provide a method for attaching two portions in a surface-to-surface interface and for connecting edges of fabric portions.

DRAWINGS

FIG. 1. Perspective view of a structure having a surface fastener zone comprising a cluster of hook-like fastening elements associated with a window.

Figure 1A:
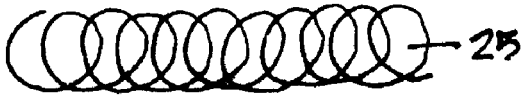
Figure 1A:
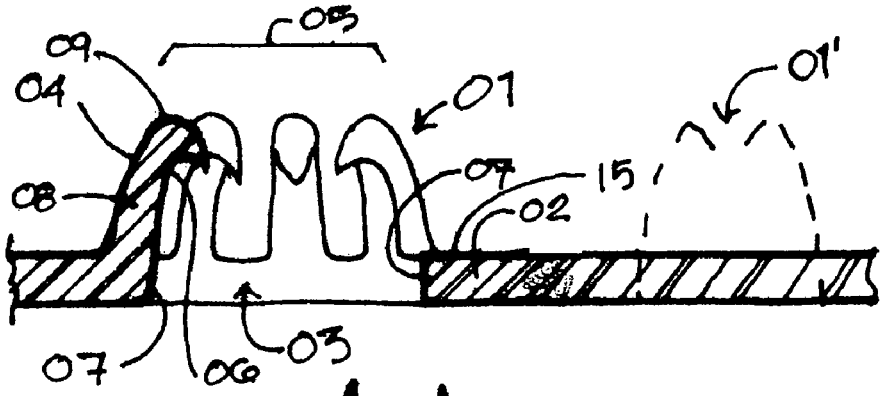

FIG. 1A Section A-A of FIG. 1

FIG. 2. Perspective view of an integrally molded surface fastener portion having sets of fastening elements associated with plurality of windows geometrically arrayed on a fenestrated structure, with fastening elements springing from ribs.

FIG. 2A Section A-A of FIG. 2

Figure 3:
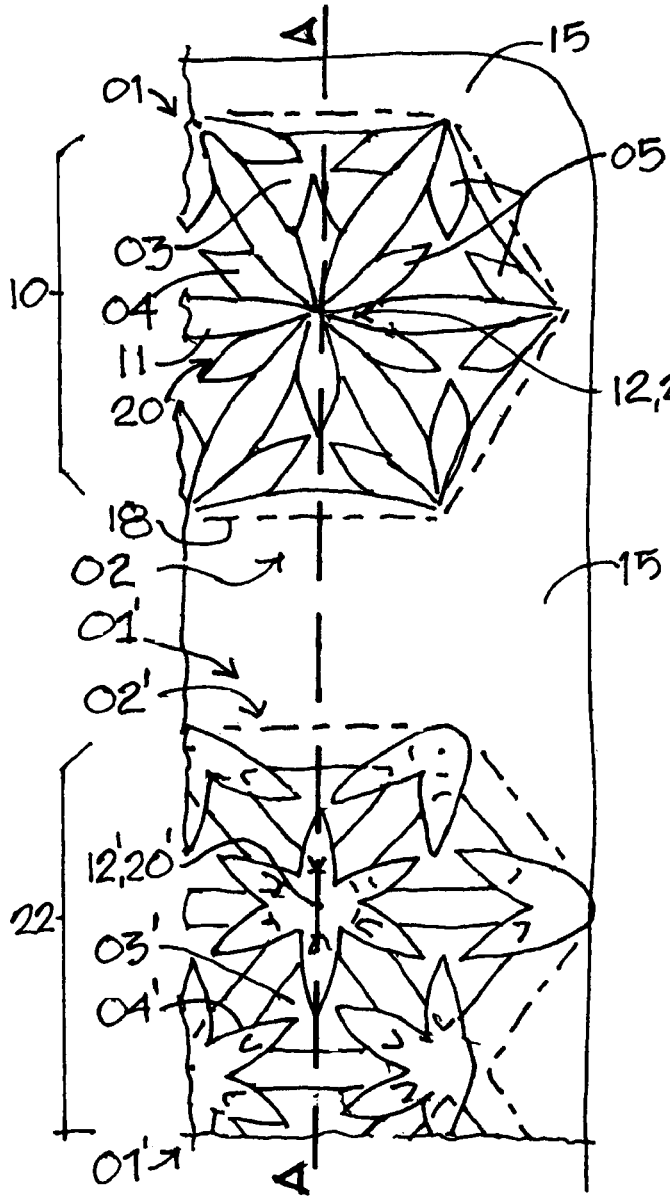
Figure 3A:
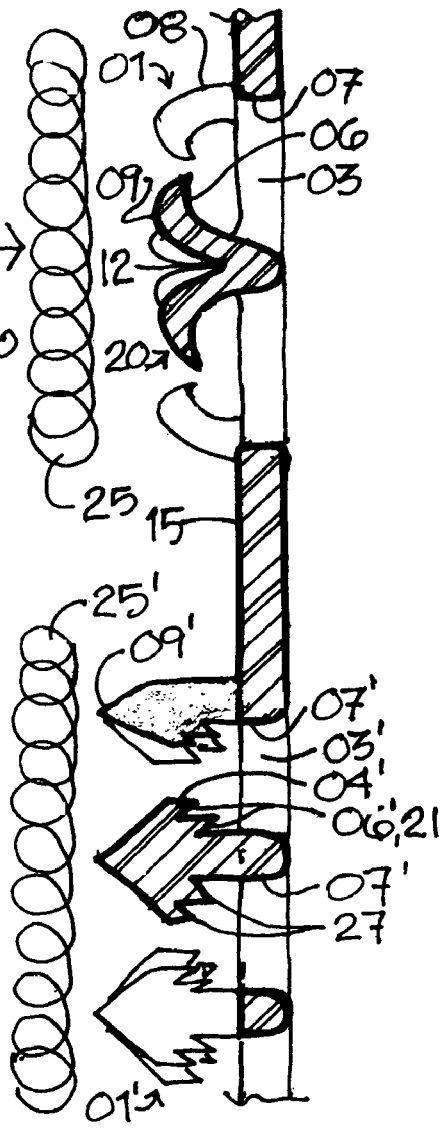

FIG. 3. A molded surface fastener including two distinct fastening zones with fastening elements arrayed in groups at interstices between windows FIG. 3A Section A-A of FIG. 3

FIG. 4 Self engaging surface fastener

FIG. 4A Section A-A of FIG. 4

FIG. 4B Method of Attachment

Figure 5:
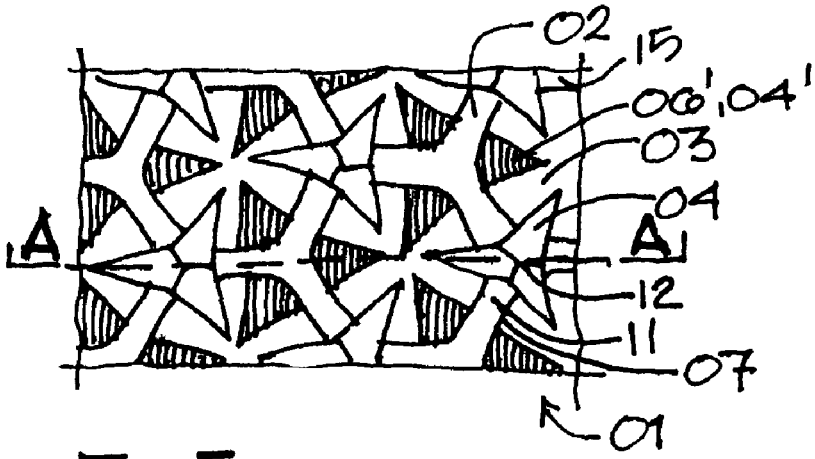

FIG. 5 Double sided hookstrip

FIG. 5A Section A-A of FIG. 5

Figure 5B:
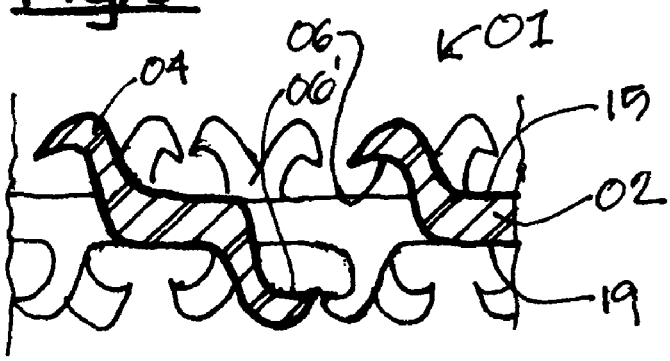
Figure 5B:
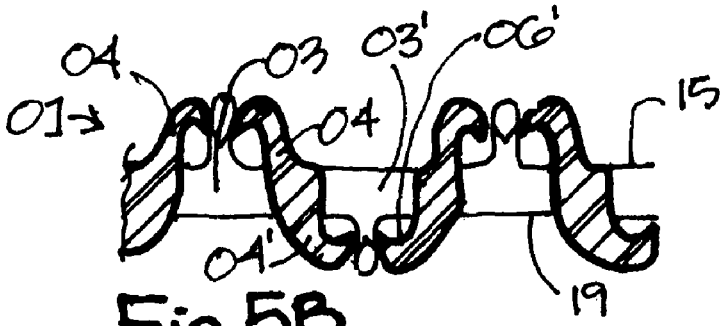

FIG. 5B Alternate Section: Alternating fasteners on opposite surfaces

Figure 5C:
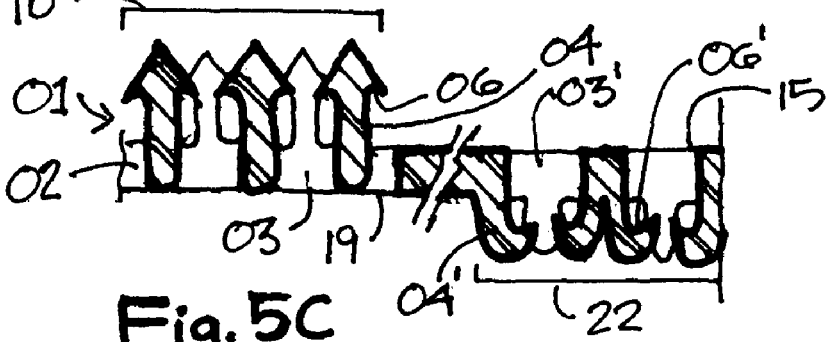

FIG. 5C Alternate Section: Double sided fastener with distinct zones

Figure 6:
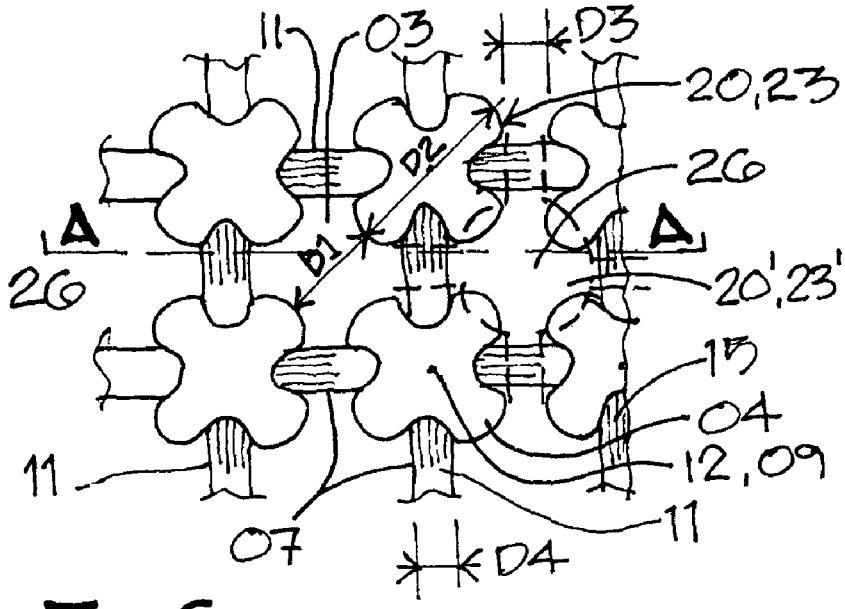

FIG. 6 Low profile self-engaging surface fastener

FIG. 6A Section A-A of FIG. 6

Figure 7:
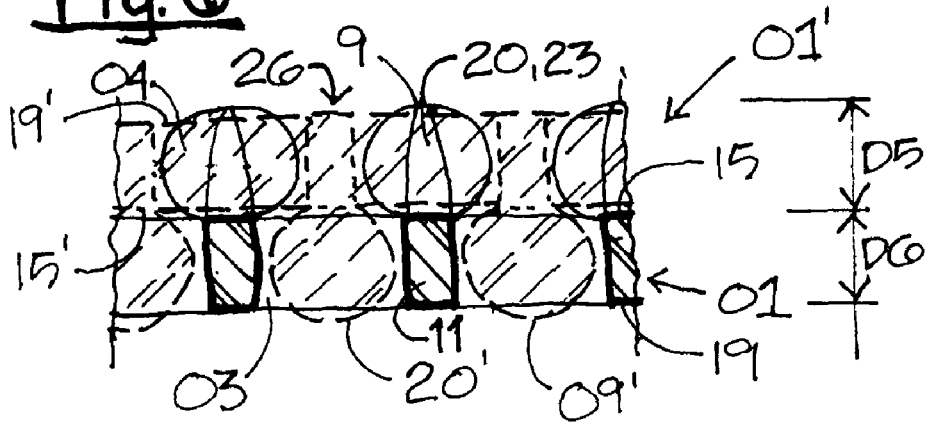
Figure 7:
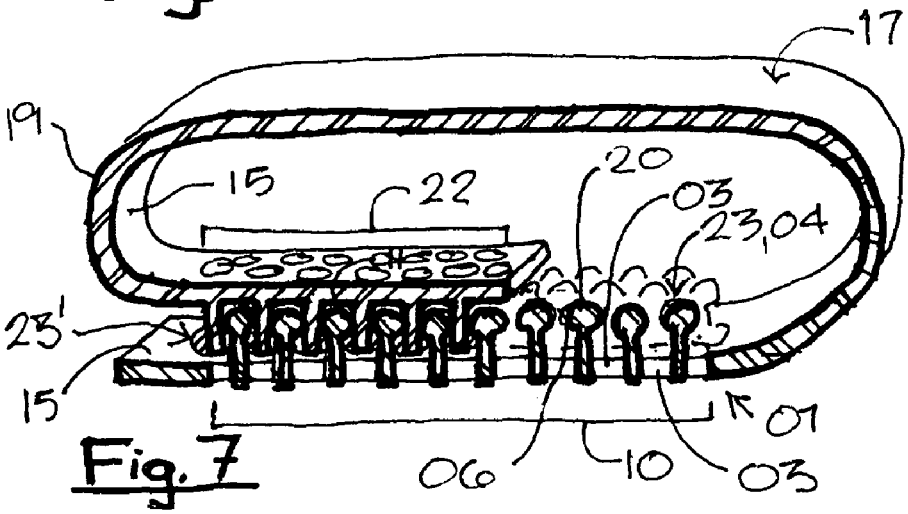
Figure 8:
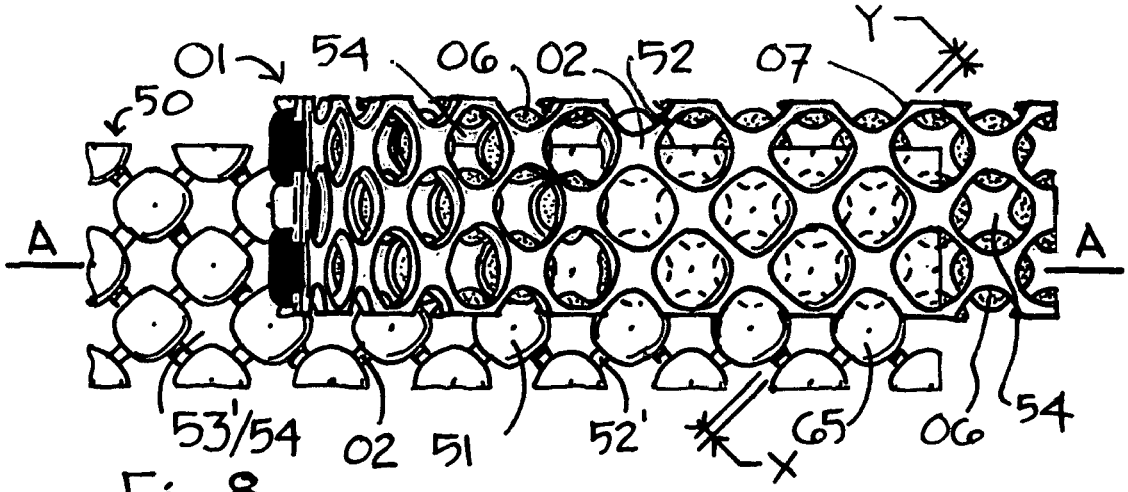
Figure 8A:
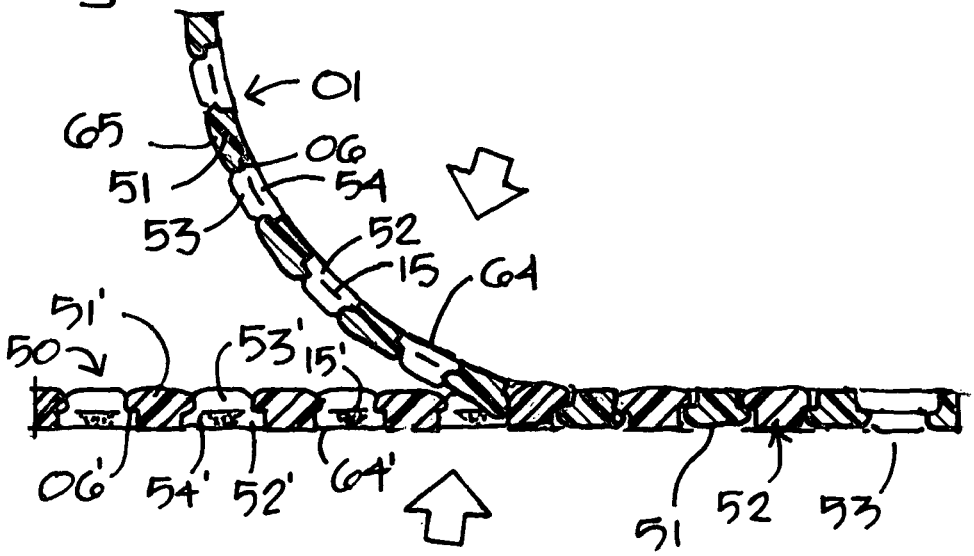

FIG. 7 Product incorporating distinct surface fastening zones on opposite surfaces FIG. 8 Plan view of self-adhering device, diagonally arrayed embodiment FIG. 8A Section view of self-adhering device of FIG. 8

Figure 9:
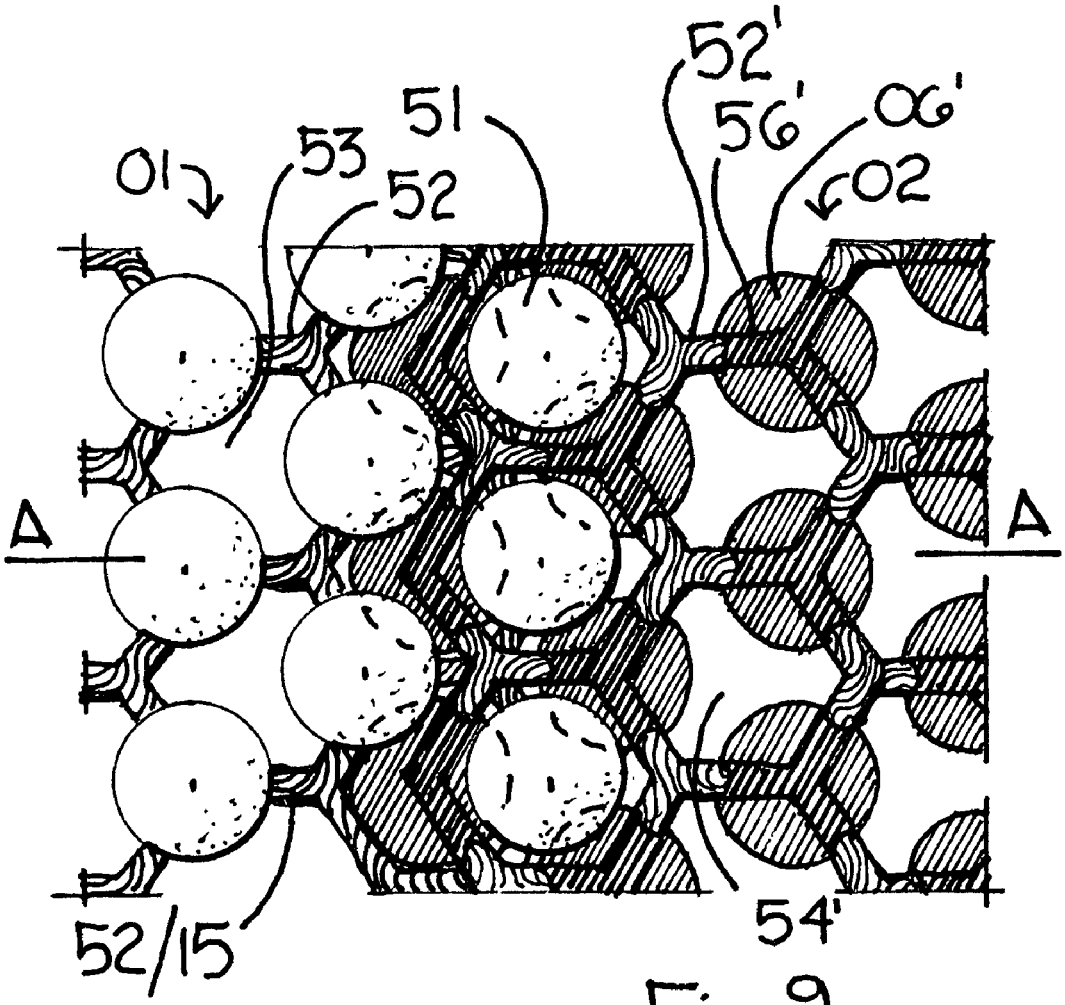
Figure 9A:
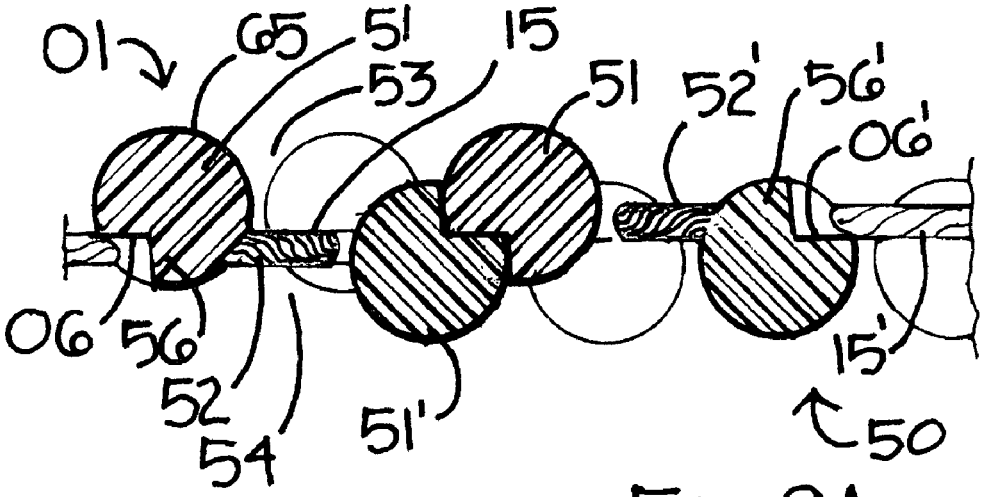
Figures 10, 10A:
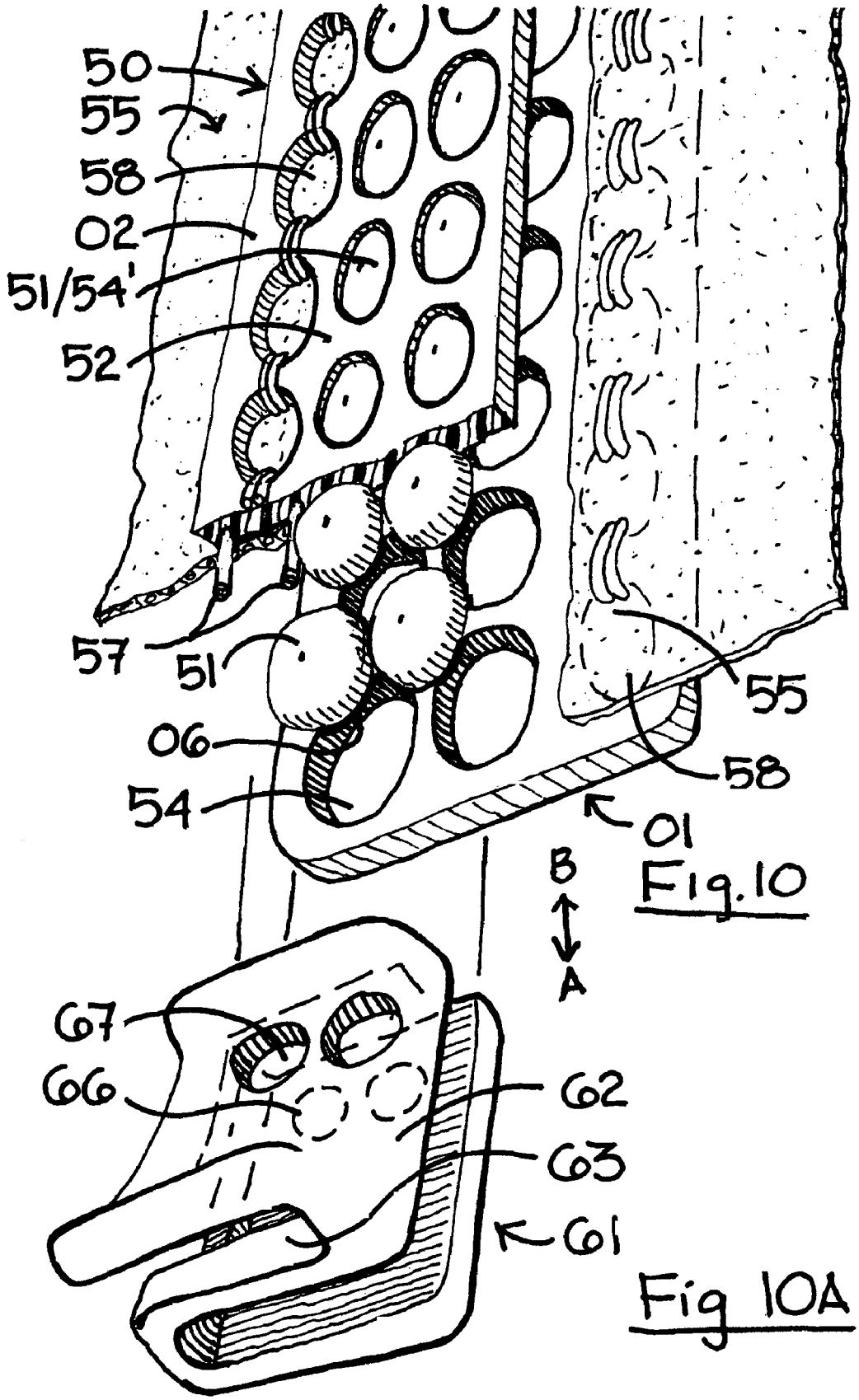
Figure 11:
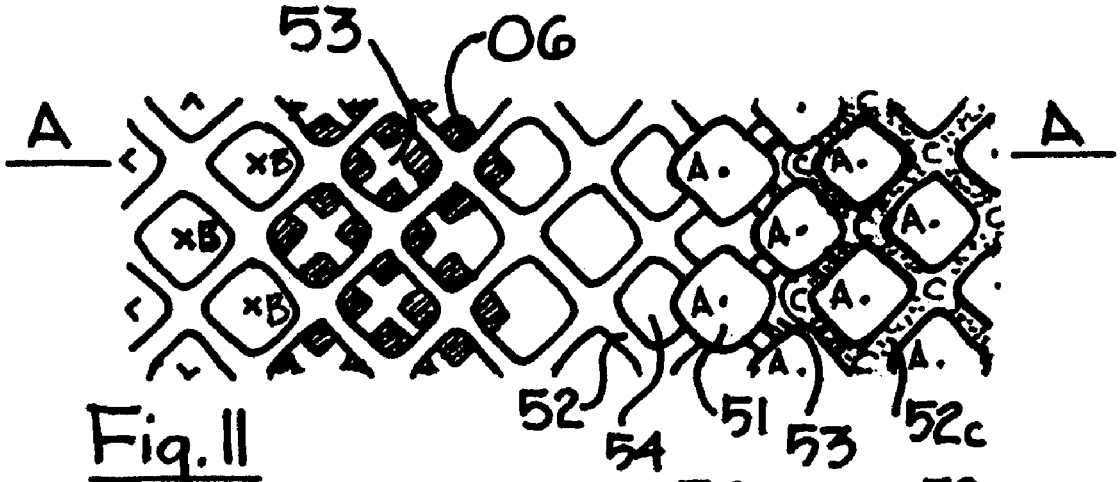
Figure 11A:
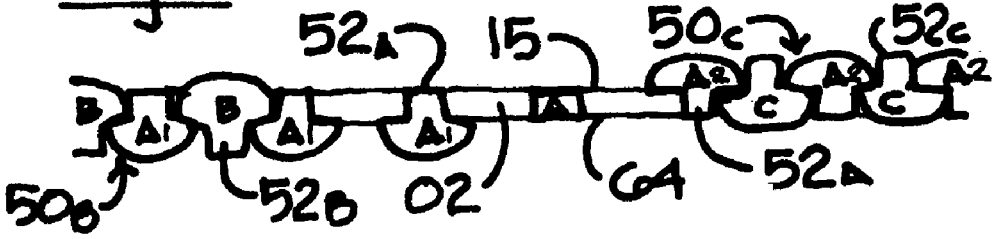
Figure 12:
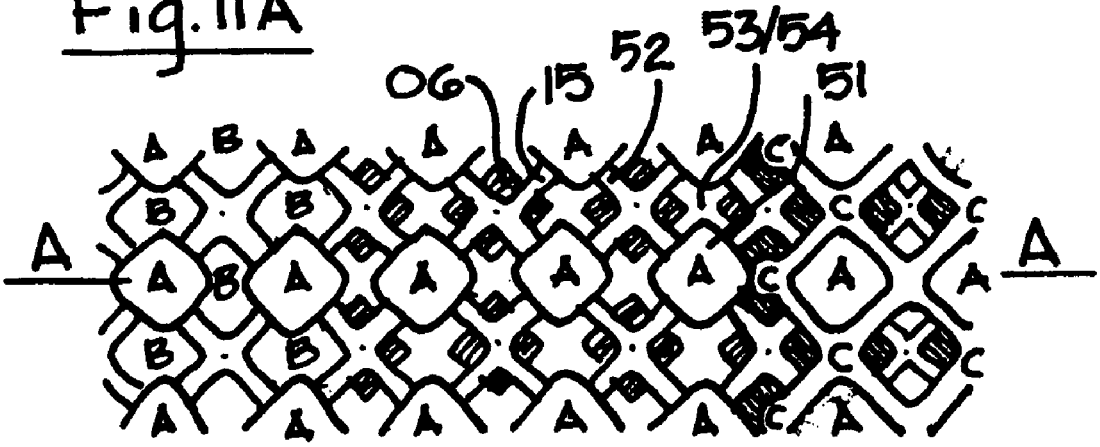
Figure 12A:
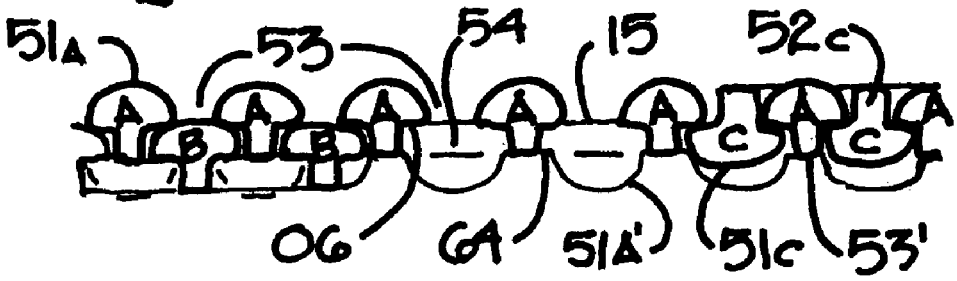

FIG. 9, 9A Plan and section views of alternative self-adhering embodiment FIG. 10A Perspective view of alternative self-adhering embodiment FIG. 10B Perspective view of optional sliding mechanism FIG. 11, 11A Plan and section views of double-sided self-adhering embodiment FIG. 12, 12A Plan and section views of alternative double sided embodiment

SUMMARY OF THE INVENTION

The present invention includes a family of surface fasteners each having a plurality of undercut attachment elements, wherein the elements are arrayed in sets of at least three, with their undercut segments extending laterally over the windows of a fenestrated base structure. The invention includes both "hook" fastener portions of diverse designs for attaching with compatible loop portions, and "self-engaging" fasteners for attaching to like portions, as well as multi-function fasteners for attaching to complementary loops or self-like components.

A significant aspect of the present surface fastener, as seen in any embodiment, is that all surfaces of the various parts may be seen from either one side or the other of the structure: that is, there are no "blind" segments requiring specialized molding methods. The underside of each fastening portion may be readily formed by one part of a biparting die-set, as the upper surfaces of each portion is formed by the other part of such a die set.

This invention also includes diverse embodiments with significant features including: integrally molded systems; examples of many possible geometric configurations; singular button-like fasteners; double-sided fastening portions; fasteners of diverse profile configurations; fasteners of multiple types incorporated on a singular structure; and fastening zones recessed from surrounding structure. The invention also includes methods for using such fasteners to attach and/or assemble various product components.

One of the immediate advantages of the present invention is that surface fastening zones can be integrally molded as part of a primary molded product or component utilizing relatively simple and economical reciprocating molding technology. By associating multiple hook elements with each window, relatively high hook density can be achieved without necessitating exceptionally small and delicate male mold segments. Fastener portions of diverse types with elements of precise design can therefore be economically and rapidly produced.

Another immediate advantage of the present invention is that such relatively high density hook portions can be readily produced, as either stand-alone products or integrated structural components, without limitation relative to extraction of undercut segments from the mold, with little limitation in materials, and reasonably short dwell times in comparison to other known systems for integrally molding hookstrips.

Another advantage is that hook portions for engaging with complementary loop structures, self-engaging systems, or multi-function fasteners can be provided; and can be integrally manufactured as part of a singular product component. Therefore, using the methods taught herein, embodiments of the invention can be incorporated into manufactured product components for attachment to complimentary loop portions, for attaching two components to an intermediary loop portion, for attaching two loop portions with an intermediary double sided hook portion, or for attaching the components directly with a self-engaging embodiment of the invention.

Furthermore, hooks of differing designs can be incorporated within a singular product. For instance a hookstrip or product component may have a first zone of hooks designed for relatively permanent attachment and a second zone with hooks designed for relatively easy release; as in a self attaching fastening tab for a diaper or clothing product. A fastening portion or product component may also include attachment elements extending from, and integral with, both sides of a singular base structure thus providing a means for attaching two overlapping loop-bearing elements.

A self-adhering device and method for providing surface-to-surface interface is configured as two portions each having a fenestrated structure with protruding nodules is illustrated in FIGS. 8-11. This device includes "stem-less" nodules protruding from the interstices of web members which have undersides effectively aligned with the surface so as to conjoin with a like portion in a surface-to-surface interface having no additive fastener thickness. The device may be optionally furnished in diverse geometrical arrays, as a double-sided fastener, or with an optional slide mechanism. It is useful as a low-profile self-adhering strap or wrap, as well as closure for adhering fabric edges.

Description

As can be seen in FIGS. 1-7, the present surface fastening portion 01 includes a fenestrated base structure 02 with at least one window 03 and a plurality of fastening elements 04 arrayed in sets 05 of at least three such elements adjacent to each such window. Each fastening element is configured so that an underside 06 extends laterally over the window. Such fastening portions are preferably but not necessarily manufactured by an apparatus which includes a set of bypassing biparting dies.

As used herein, the term "window" refers to an aperture, extending through a generally planar structure, which is defined by an edge 07 at its perimeter. The term "fastening element" is defined as a projection extending from the base structure 02 at edge 07 comprising at least a stem segment 08, a distal end 09, and underside 06. As seen in the drawings FIGS. 1-7, the stem portion of a fastening element 04 may extend obliquely or generally perpendicular relative to the surface 15 of the base structure 02 and may be designed to include various aspects and proportional relationships between its parts, but is typically characterized by having at least one underside 06 extending laterally beyond the edge 07 of an adjacent window 03.

FIGS. 1, 1A schematically illustrates an embodiment of a fastening portion 01 wherein a base structure 02 is fenestrated with at least a singular window 03 having an associated set 05 of at least three fastening elements 04. The undersides 06 of the fastening elements extend laterally from the edge 07 of the window 03 over the window opening, and are spaced from one another at their distal ends 09. In this embodiment, the fastening elements 04 include a hook-like profile intended for engagement with a compatible loop-bearing material 25, of fabric or like structure. Within the scope of this invention, the shape, stem length, spacing between distal ends, and geometry of the fastening elements 04 can be designed to optimize engagement characteristics as well as other factors such as tendency to grab, peel strength, stiffness, profile height, surface texture, etc. Such a set of fastening elements may be readily provided virtually anywhere on the surface of a generally planar structure; as a singular item as shown in FIG. 1, in a random pattern 01', or in a geometric array as in FIGS. 2-7 as generally preferred for many potential applications.

Another optional aspect of the present invention seen in the embodiment of FIG. 1 and others to follow, is that the fastening elements 04 are preferably, though not necessarily, oriented in multiple radial directions. By eliminating the "grain" typical of presently available molded fasteners, this factor provides fasteners which are equally resistive to shear or peeling forces applied in any radial direction.

Factors such as the length of the fastening elements 04 relative to the base, shape, flexibility, etc. may be varied by design within the scope of the invention; longer elements, for instance, generally provide greater flexibility and increased tendency to grab while shorter stiffer elements generally providing stronger adherence and less grab.

FIG. 2 schematically illustrates a segment of an integrally molded embodiment type, recessed from at least part of the surrounding product surface, which includes a fenestrated base structure 02 having a first fastening zone 10 with a plurality of windows 03 arrayed in a geometric pattern. In such a geometric array, the fenestrated structure at the fastening zone effectively comprises a plurality of ribs 11 between adjacent pairs of windows 03, and a plurality of interstices 12 occurring between clusters of at least three adjacent windows. At least some of the windows 03 are associated with sets of at least three fastening elements 04, which fastening elements are adjacent to the edge 07 of each such window and include undersides 06 which each extend over the associated window. In this embodiment, stem 08 of each fastening element 04 can be seen to effectively extend from the fenestrated structure's ribs 11 and are here arrayed in a geometric pattern wherein sets of four hook-like fastening elements 04 are associated with each window 03. It can also be seen that other windows 13 may be associated with less than three fastening elements 04 as might be located at the perimeter 18 of a fastening zone 10.

The embodiment illustrated in FIG. 2 also discloses an important optional aspect of the present invention wherein a fastening zone 10, integrally manufactured as part of a product component 17, with a fenestrated base structure 02 having a first surface 15, may be recessed or otherwise differentiated from at least part of the surrounding surface 16 of the product component. Thus in this embodiment, the first surface 15 of fenestrated base structure 02 is located in a different plane than at least part of the surrounding surface 16 of the product component. Such a configuration allows the fastening zone 10, which necessarily includes a plurality of small elements relatively vulnerable to damage, to be somewhat protected by the surrounding structure when subjected to a physically harsh environment. Additionally, certain applications may utilize such a differential surface treatment for other functional purposes. This aspect of differentiated surfaces can be effectively applied to any embodiment of the present invention and will also be seen in FIG. 4B.

Such a configuration also allows two product components to be assembled in an essentially flush surface-to-surface juxtaposition, by incorporating appropriate dimensioning, as seen in FIG. 2A by a method which includes: first, providing two fastening portions 01, 01', at least one of which is recessed from its surrounding surface; secondly, attaching a first portion 01 to an intermediary loop-bearing material 25; thence, attaching the second portion 01' to the loop-bearing material 25, so that the portions are effectively assembled in a generally flush disposition.

FIG. 3 schematically illustrates an embodiment type which includes a structure with two distinct fastening zones 10, 22 integrally molded as part of a generally planar fenestrated structure 02 with the first fastening zone 10 having a geometric array of windows 03 and associated hook-like fastening elements 04 so as to provide a button-like cluster, and the second fastening zone 22 also having an array windows 03' with fastening elements 04' of a different design. It can be seen here that the first fastening zone 10 includes fastening elements 04 arrayed in groups 20, located at the interstices 12 of the fenestrated base structure 02 and includes individual fastening elements 04 having distinct independent stems 08 here extending generally obliquely from the surface 15 of base structure 02. The second fastening zone 22 also has a fenestrated structure 02' with windows 03' and associated fastening elements 04' of a different type in which the groups of such elements 04' have a common stem 21, extending generally perpendicular to surface 15, with individual underside segments 06' extending laterally over each associated window 03' adjacent to the common stem 21.

An embodiment such as this, with two or more fastening zones having distinct types of fastening elements can be useful in applications where a differential grip might be desired by utilizing a method which includes attaching the first zone 10 to a first complementary portion, then attaching the second zone 22 to a second complementary portion so as to connect the complimentary portions. By providing the portions with differentiated grip strength such an embodiment could be used as a clothing tab wherein the second zone 22 is effectively permanently attached to a loop-bearing material 25 and the first zone 10 is adjustably attached and/or removed at the point of use. It should also be noted that the fastening elements 04' of the second zone 22 include multiple hook barbs 27, so as to afford enhanced engagement with a complementary loop-bearing material. Providing multiple hook barbs or other relatively precise enhancements in the shape of fastening elements is a distinctive feature of the present invention, wherein such precise definition may be provided by a manufacturing apparatus that includes a die projecting through a window 04, 04' so as to precisely mold the shape of underside 06, 06'.

FIG. 4 schematically illustrates a self-engaging embodiment of the invention in which the fastening elements 04 are also arrayed in groups 20 with a common stem 21 located at interstices 12 between at least three adjacent windows 03. As in other embodiments, the undersides 06 of fastening elements 04 extend laterally over each associated window 03. However, in this type of embodiment, with the distal end 09 of the common stem extending perpendicularly beyond the individual fastening elements 04, each group 20 effectively comprises a bulbous stem 23. A plurality of such bulbous stems 23 manufactured of a relatively resilient material and configured and arrayed relatively closely on a first fastening portion 01 self-engages with a complimentary set of bulbous stems 23' oppositely disposed on a second portion 01' when subjected to a relative compressive force. Therefore, a self-engaging fastener is provided by this type of embodiment. Such self-engaging systems, as in prior art, are preferably furnished with an unaligned pattern so as to allow random engagement and enhance shear resistance; one means of providing such a pattern is illustrated here by offsetting window rows 03, 03A. Furthermore, in that the undersides 06 of fastening elements 04 in this instance also have an essentially hook-like profile, such a multiple-functioning embodiment can alternatively be utilized for engaging with a complementary loop-bearing material 25 as well as for self-engaging.

As in the embodiment illustrated in FIG. 2, self-engaging fastening portions can also be recessed relative to the surface of a surrounding structure. Therefore, as schematically illustrated in FIG. 4B, two product components 17, 17' may be securely assembled in a flush surface-to-surface juxtaposition by providing at least the first portion 01 with a first fastening zone 10 comprised of a plurality of bulbous stems 23 which zone is recessed from a surrounding surface 16, then providing a complementary second portion 01' with a complimentary second fastening zone 22, wherein both portions are dimensioned so that when the portions are self-engaged by application of a relative compressive force, the first surrounding surface 16 effectively engages in a flush disposition with the second surrounding surface 16'.

FIG. 5 schematically illustrates an embodiment type which provides a double-sided fastener portion. A fenestrated base structure 02 includes windows 03 each having a plurality of associated hook-like fastening elements 04 and 04' extending over the associated window beyond edge 07. In this embodiment, the first set of such fastening elements 04 generally protrude from the first surface 15 of the structure 02, and a second set 04' generally protrude from the second surface 19 which is generally parallel and opposite the first surface.

A double-sided fastener portion such as that shown in FIG. 5 can be used to connect two loop-bearing fabrics or other materials, or to effectively hem a single folded fabric by a method which includes: engaging a first complementary loop-bearing fabric portion with the fastening elements 04 projecting from first surface 15 of the fastening portion; then engaging a second such fabric portion with fastening elements 04' projecting from the second surface 19, effectively sandwiching the fastening portion 01 between the loop-bearing portions, thereby connecting the portions.

It should be appreciated that double-sided fastening portions can be readily provided within the scope of the present invention by at least three distinct means. By a first means, as illustrated in FIG. 5, sets of fastening elements 04, 04' extend from each surface 15, 19 in association with ones of windows 03. By a second means, as in FIG. 5B, fastening elements 04 associated with certain windows 03 extend from the first surface 15, as in previous embodiments, and fastening elements 04' associated with alternate windows 03' extend from the second surface 19. By a third means, as seen in FIG. 5C, a first zone 10 of fastening elements 04 extend from the first surface 15, and a second zone 22 of fastening elements 04' associated with a different plurality of windows 03' extend from the second surface 19 at a different location on the structure.

It should also be noted that as in other embodiments, double-sided fastening portions of the type of FIG. 5 may optionally include differentiated types of fastening elements extending from opposite surfaces as seen in FIG. 5C. Therefore a double-sided fastening portion may be provided within the scope of this invention which, for instance, is designed so that the first surface 15 grips relatively securely to provide a relatively permanent connection while the second surface 19 grips less firmly to provide intermittent reclosure and adjustment; as might be useful for a diaper closure, clothing "button", or other application. Likewise, a double-sided fastening portion can be provided with hook-like fastening elements 04 extending from a first surface 15 and self-engaging fastening elements extending from second surface 19. Furthermore, a double-sided self-engaging strap may be readily provided with fastening zones functioning on opposite surfaces at separate locations as will be seen in FIG. 7.

An alternative type of self-engaging fastener is illustrated in FIG. 6 which provides a very low-profile fastening system. In this embodiment groups 20 of fastening elements 04 are located at interstices 12 of the fenestrated base structure 02 wherein windows 03 are arrayed in a generally quadrille pattern. The groups of fastening elements 20 share a relatively short bulbous common stem 23 which projects above the first surface 15, preferably by a distance D5 approximately equivalent to the thickness of the fenestrated base structure D6 as measured between the first 15 and second 19 surfaces. Sets of fastening elements 04 extend over each window 03 and define a receiving aperture 26 with a diagonal dimension D1 which is at least slightly less than the dimension D2 as measured diagonally across a typical group 20 of enjoined fastening elements 04. Dimension D3 as measured between groups 20 in a rectilinear direction is at least equal to the width D4 of a typical rib 11. Therefore, when at least the segment of fastening element 04 which extends laterally over each window 03 is manufactured of a sufficiently resilient material, a second such fastening portion 01', oriented in an opposed disposition may be compressed into engagement with the first fastener portion 01 so that groups of fastening elements 20' are effectively contained within windows 03 and ribs 11' of fenestrated structural base 02' are contained between adjacent bulbous stems 23. Therefore, the resilient fastening elements 04, 04' effectively contain groups 20, 20' of respective complementary portions 01, 01'.

It can be appreciated that, unlike other embodiments, the embodiment of FIG. 6 requires that the portions 01, 01' be generally prealigned before compressing them into engagement and that this type of embodiment is preferably provided in a quadrille pattern. However, by manufacturing the portions so that the groups 20 of combined fastening elements 04 with a common stem 21 have a generally bulbous configuration 23 with distal end 09 protruding beyond the lateral bulbous projections, the portions 01, 01' will tend to at least partially self-align as the protruding distal ends 09 of the common stems 21 begin to enter receiving aperture 26, thereby allowing an approximately aligned pair of portions to become fully aligned in a pre-engaged disposition, prior to full engagement by the relative compressive force.

A product component 17 having integrally molded zones 10, 22 of self-engaging fastening elements and their associated windows is schematically illustrated in FIG. 7. In this embodiment, intended to exemplify one of many possible configurations, a first zone 10 of fastening elements 04 protruding from first surface 15 of a flexible contiguous strap, and a second zone 22 of fastening elements 04' protruding from a second surface 19 elsewhere on the strap. In that the groups 20 of fastening elements with bulbous common stems 23, 23' are designed and arrayed so as to self-engage as in FIG. 4 above, thereby a unitary adjustable self-engaging strap useful for many common applications is provided as one example of many possible applications of the present invention.

Regarding Interfacing Self-Adhering Closures:

FIGS. 8-11 schematically illustrate a unique self-adhering closure system in which two portions engage in a surface to surface interface, the resultant assembly effectively having no additive engagement thickness when engaged than when unengaged. This device can be usefully applied as a self-adhering adjustable wrap, strap or tape; or for joining the edges of two product portions, such as fabric edges of an article of apparel. The two portions 01, 50 are effectively conjoined along the interfacing first surface 15 of each portion, connected by the interdigitating nodules 51 of each portion which are received and entrapped within corresponding respective receptors 54 of the other. At least one of the portions includes resiliently flexible segments allowing the temporary distortion of fastening elements during connection and disconnection.

As schematically illustrated in a first preferred embodiment of the self adhering device in FIG. 8, two effectively identical portions 01, 50 each comprise a fenestrated base structure 02 with an effective first surface 15, a plurality of two-dimensionally arrayed receptors 54 opening to at least the first surface 15, a plurality of web members 52 located between adjacent receptors 54, and a plurality of nodules 51 projecting from the first surface 15 at the interstices of adjoining web members 52. The nodules of each portion have undersides 06 which are effectively aligned with the first surface 15 and extend over the receptors 54 so as to define receptor openings 53 which are each at least somewhat smaller, as measured in a plane immediately above the first surface 15, than the area of a corresponding receptor 54, as measured in a parallel plane immediately below the first surface 15. The portions are further configured so that at the surface 15, each receptor 54 is at least as large as a corresponding respective nodule 51, and the distance "x" between adjacent nodules 51 is at least as large as the width "y" of corresponding web members 52. At least one of the portions 01, 50 includes resilient segments so that when nodules 51 of the first portion 01 are aligned with receptor openings of the second portion 50 and the portions are compressed together, elements of at least one portion are resiliently distorted enough to allow passage of at least one nodule 51 through a corresponding receptor opening 53 into a receptor 54. Upon arrival of the nodule 51 in the receptor 54 the portions resiliently return to their original configuration, thereby entrapping the nodule by interfacing at least segments of the undersides 06 of each portion with those of its counterpart, effectively interlocking the portions. When disconnection is desired, the portions 01, 50 may be readily peeled apart in a sequential manner initiated by forcibly separating a single nodule 51, or a row of such nodules.

With regard to the embodiments of FIGS. 8-11, the terms "effectively aligned" or "coplanar" are intended to define an aspect of the invention in which at least a segment of each respective corresponding underside is generally aligned with the first surface and generally parallel to and engaging with a counterpart underside, within an effective tolerance causing the surfaces of engaged portions overall to be retained in an effectively interfaced disposition. Although the undersides 06 may be slightly inclined from the surface plane 15 as a matter of design or to ease bypass of the elements, it is generally preferred that the undersides not be inclined more than approximately 30 degrees. It is important to note that the nodules 51 are not separated from the surface by a stem as in typical mushroom-type fasteners or other prior art. The terms "surface" and "plane" are intended to denote a generally static aspect of the device at a localized circumstance and are not intended to preclude the significant three-dimensional distortion characteristic of a generally flexible structure which is an important aspect of the invention. The term "resilient distortion" is intended to refer to an overall aspect of each portion as a whole and not necessarily to any particular individual element. Therefore, the device may be furnished as an integral structure manufactured of a generally resilient material such as a relatively low durometer thermoplastic or silicon, or with only certain resilient elements such as for instance either the nodules or the web members, or alternatively with only resilient web members of a particular orientation (i.e. longitudinal), or combinations of such aspects selected for a particular design purpose. Therefore, while it is essential that at least one portion of the device have at least some resilient element or combination of elements sufficient to allow the portion as a whole to temporarily distort enough to receive the nodules of another portion and then assume its original configuration, the choice of which element is to be resilient is a matter of design. In general, three-dimensional flexibility and resiliency of both portions is desirable for many foreseen applications.

It should be noted that the nodules of the preferred embodiments are generally characterized by having inclined or curved top surfaces 65. This important aspect, wherein at least the edges of the top surface are inclined, effectively self-aligns the portions as they are initially engaged, causing the individual nodules to align with corresponding receptor openings as increasing compression forces the elements to slide laterally along their respective inclined surfaces into a pre-engagement position. As further compression is applied, the leading relatively thicker high point of each nodule is progressively forced through its respective receptor opening, causing segments of the structure to resiliently distort as the nodules enter and continue through the receptor openings.

The portions are attached by utilizing a method comprising: first, providing and generally aligning two portions 01, 50 of the device, at least one of which including resiliently flexible segments, so that the nodules 51, 51' of each portion confront one another; then, initiating a relative compressive force on the portions until pairs of the confronting nodules first slide laterally past one another along inclined tops 65, 65' into alignment with corresponding receptor openings 53; then, continuing compression so as to cause the first nodules 51 of the first portion 01 to enter into corresponding respective receptor openings 53' of the second portion 50 so that at least one of the first nodules 51 fully bypasses at least two second nodules 51' and is received within a corresponding receptor 54, thereby causing underside segments 06 of each first nodule to effectively engage with segments of the undersides 06' of at least two corresponding respective nodules 51' of the second portion 50 as the first surfaces 15, 15' of each portion simultaneously engage in an interfacing surface to surface disposition, thereby effectively connecting the portions 01, 50. Likewise, two end product portions, such as the fabric edges 55 of a clothing, footwear, or orthopedic product as will be seen in FIG. 10, are connected by a method comprising first attaching two portions 01, 50 of the present invention to edges 55 of the product portions, thence proceeding with the method described above.

It is to be understood, within a matter of normal design consideration, that the interengaging segments of either portion may be momentarily forced beyond their respective final positions in order to cause the full resilient recovery of the respective structures into their optimum engaged configuration, because the edges of underside segments 06 must bypass each other before resiliently resuming their shape. Working tolerances are to be provided as necessary to enhance operation of the device.

FIG. 8 schematically illustrates a first preferred embodiment of the invention in which each of two effectively hermaphroditic portions 01, 50 is comprised of an integral flexible and resilient material. Nodules 51 protrude away from the first surface 15 a distance normal to the surface approximately equal to the thickness of the web members 52, as measured between the first surface 15 and an opposite second surface 64 spaced from and generally parallel to the first surface. It is preferable that the edges of nodules are contiguous with the surface 15 of adjacent web members at their respective intersections. The receptors 54 effectively provide windows 03 communicating between the first and second surfaces 15 and 64. The web members 52 are arrayed here in a diagonal matrix-like pattern and each have a width "y", measured on the surface 15 between edges 07 of adjacent receptors, not greater than the distance "x" between adjacent nodules. Thus, when the portions 01, 50 are engaged by the method described above, the overall assembled thickness of the engaged portions is approximately equal to the overall thickness of each component prior to attachment. This optional aspect of the invention relative to thickness is generally desirable for many applications in that it results in an attached assembly of minimal profile with a generally smooth uniform minimally textured surface, particularly desirable for wraps and/or apparel applications in contact with the skin surface, or other applications where a generally uniform interface is desirable. The optional aspect of a diagonal array of web members is also desirable for many applications in that it allows a uniformly flexible and resilient structure, adjustable in two dimensions, to stretch in multiple dimensions in either its unattached or attached disposition.

FIG. 8A schematically illustrates the portions in cross section in both attached and unattached dispositions as well as illustrating the method of attachment described above wherein the portions are compressively engaged.

FIG. 9 schematically illustrates an alternative embodiment of a self-adhering closure with several optional aspects in which the portions 01, 50 each include a plurality of nodules 51 with nodule bases 56 intersecting alternate interstices of a hexagonal web made up of generally flexible cord-like web members 52, here materially distinct from the nodules but integrally attached to provide an effectively homogeneous structure. The nodule bases 56 comprise the segment of each nodule extending below the surface 15 of web members 52 and undersides 06, whereas the nodules 51 comprise the contiguous segment extending away from the first surface 15 having undersides 06 generally aligned with the plane of such surface. In this embodiment, the nodules 51 and nodule bases 56 as illustrated may be made of a generally rigid material fixedly molded to flexible web members 52 and at least some of the web members may optionally be elastic. Therefore, when attachment of two portions 01, 50 is initiated by compressing the portions 01, 50 together, the relatively rigid nodules force their respective counterparts to temporarily separate laterally, allowing entry of the nodules 51 through their corresponding receptor openings 53 until nodule undersides 06 engage and the nodules resiliently resume an engaged disposition. It is noted that in this embodiment, as a matter of design, the nodules 51 as illustrated protrude from the surface 15 of relatively thin cord-like web members by a distance normal to the surface greater than the thickness of the web members 52, thereby resulting in an assembly with a generally bulbously textured exterior surface which may optionally be slightly thicker than the individual unassembled portions. Likewise, as a matter of design in any embodiment, the nodules 51 might optionally protrude by a distance less than the thickness of web members, thereby being encapsulated within the thickness of respective portions. As in the diagonally arrayed web members 52 seen in FIG. 8, this embodiment of FIG. 9 can accommodate significant stretching and flexing in both assembled and unassembled dispositions as an aspect of its geometry. Furthermore, in general, embodiments of any design having fully flexible web members made of elastic or inelastic cord-like materials can provide significant flexibility for many applications as well as unique decorative possibilities for apparel, jewelry, housewears, etc.

FIG. 10 schematically illustrates in perspective view an embodiment of the self-adhering closure device with web members 52 and nodules 51 arrayed in a quadrille grid-like array. Nodules 51 and corresponding receptors 54 are illustrated as effectively circular, with the receptors 54 at least as large in diameter as the nodules 51. The portions are illustrated as each comprising two rows of nodules 51 on a fenestrated base 02 which also includes a fenestrated selvage area 58 for attaching to the edges 55 of sheet-like product components, such as fabric portions of an article of clothing, illustrated here as attached by sewing. The term "fabric" is intended to include a wide range of generally flexible sheet form materials including but not limited to woven cloth, paper or fiber products, non-woven fabrics, plastic, leather, rubber, composites, etc. Therefore, the present invention may be applied as a replacement for a zipper-type slide fastener, hook-and-loop, or other known means for connecting fabric edges. Such an embodiment has the distinct advantages of providing a three-dimensionally flexible effectively "jamb-proof" closure which can be opened and closed manually at any location along its length, whilst providing an effectively well sealed connection when engaged.

Alternatively, one or both portions of a device as in FIG. 10 can be provided with one or more additional rows of nodules and receptors, thereby providing a closure which is adjustable in width across the opening perpendicular to the edges of the portions as well as in length parallel to the edges.

A sliding closure mechanism 61 may also be utilized with the present invention as illustrated in FIG. 10A. The sliding mechanism 61 comprises a relatively rigid shell structure 62, tapering internally along its length, and includes a dividing bar 63 for progressively separating the engaged portions 01, 50. When ends of the portions 01, 50 are aligned and inserted into the wide end of the sliding mechanism 61, they are sequentially compressed into a low-profile engaged disposition by the method previously described as the sliding mechanism is moved in a first direction A along their length. If the sliding mechanism is reversed to move in a second direction B, the portions are forced to separate by dividing bar 63 sequentially moving toward the previously closed segment. The sliding mechanism 61 may also include internal compression nodes 66, projecting from the tapering internal surface, aligned with corresponding apertures 67 configured to sequentially over-compress nodules 51 beyond their final juxtaposition so as to assure sequential resilient entrapment of the nodules. Therefore, incorporating such a sliding mechanism combines aspects and advantages of traditional zippers, snap fasteners, and/or hook-and-loop fasteners in that the edge portions 55 can be closed continuously at a first segment by the sliding mechanism 61, or simultaneously at another segment by simply compressing the portions wherever a point connection is desired. Means for stopping the sliding mechanism at an open end of at least one portion is preferred and may be provided as a design feature of a fastener portion such as an enlarged nodule or other device.

Also schematically illustrated in FIG. 10 are optional reinforcing members 57, optionally elastic, molded within the matrix of web members. In general, at least one of the portions 01 or 50 is generally elastic, and preferably both portions are essentially identical for most purposes. It is important to understand that the diverse features of any embodiment or geometric array of the self-adhering device are essentially interchangeable as a matter of design. Therefore, for example, a diagonally disposed matrix as in FIG. 1 could be readily combined with the sliding mechanism of FIG. 10A to provide a zipper-like closure which is stretchable in multiple directions.

FIGS. 11 and 12 schematically illustrate alternative embodiments of the self-adhering device which are double-sided so that, for instance, a single flexible portion 01 of the device can be wrapped around an object and attached to itself in a surface-to-surface disposition providing high shear strength. Such double-sided embodiments include the device as generally disclosed above and also comprise a second surface 64 spaced from and oppositely oriented in relation to the first surface 15, with the receptors 54 communicating between surfaces.

In the first such double-sided embodiment seen in FIG. 11, a fenestrated base structure is provided with a first plurality of nodules 51 (A2) protruding from the first surface 15 at a first zone on the right side, and a second plurality of nodules 51 (A1) protruding from the second surface 64 at a second zone to the left. This embodiment also includes an optional segment of fenestrated base 02 between the fastening zones without nodules. A second portion 50, which may be a contiguous segment of the flexible base structure, is connected by the method described above to either side of the structure—with nodules (B) oriented toward surface 50 or with nodules (C) oriented toward surface 15.

In an alternative double-sided embodiment schematically illustrated in FIG. 12, nodules 51 alternatively protrude from both first and second surfaces in association with each receptor 54 at alternating interstices of web members. Thus the base structure 01 has a similar array of nodules protruding from each surface 15 and 64. Therefore, a second portion 50 may be attached to either side of the device by orienting its nodules 51 toward the second surface 50 (B) or alternatively toward the first surface 15 (C).

It should be noted that, unlike previous examples, the embodiment seen in FIG. 12 includes only two nodule undersides 06 in association with each receptor: an optional aspect of the invention for any embodiment. Although incorporating this aspect of having only two undersides per receptor in any embodiment of the invention may reduce the relative tensile resistance of the portions acting normal to the interfaced surfaces 15, 64, it has less significant effect on shear strength and may be a preferred configuration for many applications.

Other optional embodiments of double-sided self-adhering devices may include: nodules 51 located on opposite surfaces at alternate receptors of each portion; nodules 51 located opposite one another at each web member interstice (although manufacture of such multiply undercut elements may be problematic); nodules primarily located on only one surface 15 with only a small number on the second surface 64, so as to provide an adjustable strap for instance; or any other arrangement within the general scope of the invention. A wide range of useful self-adhering structures may be provided which engage in a surface-to-surface interface, such as for example straps of a type similar to that previously shown in FIG. 7.

An important optional but generally preferred aspect of the present self-adhering device is that the portions are furnished without blind undersides, the underside segments 06 of nodules 51 being fully visible from a position opposite a second surface 64 of the structure. Therefore the device in any of the embodiments illustrated here may be readily and economically produced by a set of interfacing dies assembled as part of a reciprocating or rotating molding or forming apparatus for manufacturing or integrally molding such closure portions.

It is important to understand that the term "self-adhering" as used throughout this disclosure is intended as inclusive of connecting two portions each having compatible, generally similar configurations of the disclosed device so that they are connectable by the method previously described. The term "self-adhering" is not intended to be limiting as to the overall design of the portions, as to the contiguity of structure whether of singular or plural components, nor to any other aspect of design or application. It is also important to understand that various aspects and attributes of the present invention may be generally interchanged by one skilled in the art to provide a wide range of possible design options within the scope of the invention. It is to be understood that the illustrations and specifications provided herein are intended to generally and schematically describe the various aspects of this invention and are not limiting, and furthermore that such aspects may be combined in manifold ways to produce a wide variety of useful applications within the scope of the invention.

The invention claimed is:

1. A self-adhering closure device comprising:

a first portion including a generally flexible fenestrated base structure including a first surface, a plurality of receptors each defined by a plurality of web members isolating said receptors; and a plurality of first nodules protruding from said first surface at interstices of said web members, a portion of each said nodule extending over a portion of said receptors adjacent to each said nodule, each said nodule having at least one undercut segment having an underside effectively coplanar with said first surface extending over part of an adjacent said receptor to effect a receptor opening between at least two adjacent said first nodules; said first portion configured so that, as measured relative to a plane generally coincident with said first surface, each said first nodule is larger than said receptor opening, each said receptor is at least as large as said first nodule, and the closest distance between adjacent said first nodules is at least as large as the width of each corresponding said web member; and a second portion for effectively adhering to said first portion when at least one of said first nodules are resiliently compressed through corresponding respective receptor openings into corresponding respective receptors of said second portion so that said undersides engage corresponding respective undersides of second nodules associated with said second portion.

2. A self-adhering closure device according to claim 1, wherein said web members and said nodules are integral components of a uniform elastic structure.

3. A self-adhering closure device according to claim 1, wherein at least some of said web members are elastic.

4. A self-adhering closure device according to claim 1, wherein at least some of said web members include flexible reinforcing members and said nodules are integral with nodule bases attached to said web members.

5. A self-adhering closure device according to claim 1, also including a second surface spaced from said first surface, wherein the thickness of said base is generally equal to the thickness of said nodules as measured in a direction normal to said first surface.

6. A self-adhering closure device according to claim 1 wherein the thickness of said base structure is greater than the thickness of said nodules as measured normal to said first surface.

7. A self-adhering closure device according to claim 1 wherein the thickness of said base structure is less than the thickness of said nodules as measured normal to said first surface.

8. A self-adhering closure device according to claim 1, wherein said nodules and said receptors of said first and second portions are sequentially adhered and un-adhered by a generally tapered sliding mechanism configured so as to cause said nodules to be resiliently compressed when said mechanism is moved in a first direction, and separated when said mechanism is moved in a second opposite direction.

9. A self-adhering closure device according to claim 1, wherein said nodules have top surfaces generally inclined toward the edges of said nodules, thereby facilitating alignment of said nodules with said receptor openings.

10. A self-adhering closure according to claim 1, wherein said receptors are diagonally arrayed to effect a diamond-shaped lattice, multi-directionally stretchable in both engaged and unengaged conditions.

11. A method for adhering two portions in a surface-to-surface interface, said method comprising:

providing a resiliently flexible first portion including a fenestrated base structure with a plurality of first receptors and a plurality of first nodules protruding from at least a first surface of said base structure, a portion of each said nodule extending over a portion of said receptors adjacent to each said nodule, said nodules having undersides extending over said receptors generally coplanar with said first surface, and said nodules located so as to define receptor openings smaller than said receptors and said nodules at the plane of said first surface;

providing a second portion with a plurality of second nodules and a plurality of second receptors for receiving and retaining said first nodules;

generally aligning the portions so that said first nodules generally align with second receptor openings located between said second receptors;

applying a relative compressive force to said first portion and said second portion so as to cause at least said first nodules to resiliently deform as they enter and continue through said second receptor openings into said second receptors;

whereby said first nodules thence resiliently resume their initial configuration so that said undersides engage corresponding respective undersides of said second nodules, thereby adhering said portions in said surface-to-surface interface.

12. A method for adhering two portions in accordance with claim 11, wherein said relative compressive force is applied by means of moving a generally tapered sliding mechanism sequentially along at least one row of said nodules so as to adhere the portions.

13. A method for adhering two fabric portions comprising:

attaching the edge of a first fabric portion to a resiliently flexible first portion, said first portion including a fenestrated base structure with a plurality of first receptors and a plurality of first nodules protruding from at least a first surface of said base structure, a portion of each said nodule extending over a portion of said receptors adjacent to each said nodule, said nodules having undersides extending over said receptors generally coplanar with said first surface, and said nodules located so as to define receptor openings smaller than said receptors and said nodules at the plane of said first surface;

attaching the edge of a second fabric portion to a second portion with a plurality of second nodules and a plurality of second receptors for receiving and retaining said first nodules; and proceeding with the method for adhering two portions in a surface-to-surface interface according to claim 11.

14. A self-adhering closure device according to claim 1 also including a second surface spaced from said first surface wherein at least said first portion also includes a plurality of third nodules projecting from said second surface, said third nodules for adhering with corresponding respective receptors of a third portion.

15. A double-sided self-adhering closure providing surface-to-surface interface, comprising:

a first portion including a generally flexible fenestrated base structure including a first surface, a plurality of receptors each defined by a plurality of web members isolating said receptors; and a plurality of first nodules protruding from said first surface at interstices of said web members, a portion of each said nodule extending over a portion of said receptors adjacent to each said nodule, each said nodule having at least one undercut segment having an underside effectively coplanar with said first surface extending over part of an adjacent said receptor to effect a receptor opening between at least two adjacent said first nodules; said first portion configured so that, as measured relative to a plane generally coincident with said first surface, each said first nodule is larger than said receptor opening, each said receptor is at least as large as said first nodule, and the closest distance between adjacent said first nodules is at least as large as the width of each corresponding said web member; and a second surface spaced from said first surface and a plurality of third nodules protruding from said second surface, undersides of said third nodules also for engaging with said corresponding respective undersides of said second portion.

16. A double-sided self-adhering closure according to claim 15 wherein said first nodules are located at a first zone of said structure and said third nodules are located at a second zone of said structure.

17. A double-sided self-adhering closure according to claim 15 wherein said first nodules and said second nodules are associated in sets with singular receptors.

18. A self-adhering structure comprising:

a resiliently flexible sheet form base with a plurality of receptors communicating between first and second surfaces thereof;

a plurality of nodules protruding from at least said first surface, a portion of each nodule extending over a portion of receptors adjacent to each said nodule, said nodules each contiguous with said first surface and each having underside segments extending over said receptors generally aligned and coplanar with said first surface;

said structure configured so that compressively engaging a first portion of said structure with a second portion of said structure causes said segments of the structure to temporarily resiliently distort until at least one of said nodules is entrapped within at least one of said receptors;

thereby engaging each said first surface of said first and second portions in an interfaced juxtaposition.

19. A self-adhering structure according to claim 18 also having a plurality of nodules protruding from said second surface, configured to provide a double-sided self adhering structure.

20. A self-adhering structure according to claim 18 wherein said receptors are diagonally arrayed to effect a diamond-shaped lattice, multi-directionally stretchable in both engaged and unengaged conditions.

* * * * *